US007224109B2

(12) United States Patent
Kanao

(10) Patent No.: US 7,224,109 B2
(45) Date of Patent: May 29, 2007

(54) SPARK PLUG

(75) Inventor: Keiji Kanao, Aichi-ken (JP)

(73) Assignee: Denso Corporation, Kariya, Aichi-pref. (JP)

( * ) Notice: Subject to any disclaimer, the term of this patent is extended or adjusted under 35 U.S.C. 154(b) by 184 days.

(21) Appl. No.: 11/136,393

(22) Filed: May 25, 2005

(65) Prior Publication Data

US 2005/0264152 A1 Dec. 1, 2005

(30) Foreign Application Priority Data

May 25, 2004 (JP) ..... 2004-154388

(51) Int. Cl.
*H01T 13/20* (2006.01)

(52) U.S. Cl. ..... 313/141; 313/118

(58) Field of Classification Search ..... 313/118–145; 123/169 R

See application file for complete search history.

(56) References Cited

U.S. PATENT DOCUMENTS 6,794,803 B2 9/2004 Hori et al. ..... 313/141

FOREIGN PATENT DOCUMENTS

JP 2002-343533 11/2002

*Primary Examiner*—Joseph Williams
(74) *Attorney, Agent, or Firm*—Nixon & Vanderhye P.C.

(57) ABSTRACT

A ground electrode has one end portion fixed to a metal housing, a bent portion provided at an intermediate portion thereof, and the other end portion positioned in a confronting relationship with a center electrode to form a spark discharge gap. The ground electrode contains either Ni or Fe as a main component and at least one additive selected from the group consisting of Cr and Al. A cross-sectional area S of the ground electrode is not less than 2 $mm^2$ and not greater than 3 $mm^2$. An average value D of crystal grain diameters in a thickness direction is not less than 100 μm at least at the bent portion.

18 Claims, 7 Drawing Sheets

SPARK PLUG

CROSS-REFERENCE TO RELATED APPLICATION

This application is based upon and claims the benefit of priority from earlier Japanese Patent Application No. 2004-154388 filed on May 25, 2004 so that the description of which is incorporated herein by reference.

BACKGROUND OF THE INVENTION

The present invention relates to a spark plug for an internal combustion engine.

In general, a spark plug includes a metal housing having a fixing screw portion provided on an outer surface thereof so as to be installed to an engine via this fixing screw portion. An insulator, fixed in the metal housing, has one end portion protruding from one end portion of the metal housing. A center electrode, fixed in an axial hole of the insulator, has one end portion protruding from one end portion of the insulator. A ground electrode has one end portion fixed to the metal housing, a bent portion provided at an intermediate portion thereof, and the other end portion positioned in a confronting relationship with one end portion of the center electrode to form a spark discharge gap.

For example, the Japanese patent application laid-open No. 2002-343533 corresponding to the U.S. Pat. No. 6,794,803 discloses a conventional spark plug capable of securing good heat-resisting properties of a ground electrode based on improvement in the relationship between a surface area and a volume of this ground electrode.

Recent advanced engines are generally required to have low fuel consumption and high power output. To assure stable ignition with lean fuel mixture, the flow velocity of fuel mixture tends to be increased at a spark discharging portion of the spark plug.

SUMMARY OF THE INVENTION

In general, improvement of ignitability depends on growth of the flame kernel formed after spark discharge. However, if the mixture flow velocity is fast, the flame kernel will be shifted toward a ground electrode and will be brought into contact with the ground electrode. As soon as the flame kernel contacts with the ground electrode, the flame kernel loses its thermal energy. This phenomenon is referred to as quenching effects. The quenching effects lessen the ignitability.

To reduce quenching effects, it is effective to reduce the thickness of the ground electrode. However, reducing the thickness of the ground electrode will reduce the thermal capacity of the ground electrode. Accordingly, the ground electrode will have insufficient heat-resisting properties.

Considering these problems, it is prospective to provide a spark plug capable of securing sufficient heat-resisting properties based on improvement in the composition of the ground electrode even when the thickness of this ground electrode is reduced.

More specifically, according to the inventor of this patent application, it is preferable that the ground electrode contains either Ni or Fe as a main component and at least one additive selected from the group consisting of Cr and Al.

In high-temperature engine operating conditions, additive elements having relatively small standard formation free energies are easily oxidized than the main components having relatively large standard formation free energies.

Accordingly, the additive elements shift toward the surface of the ground electrode and form surface oxides there.

Namely, adding Cr or Al as additive elements to the ground electrode enables the ground electrode to form a stable surface oxide layer (i.e. a coating layer) of the additive elements on the surface, as each of Cr or Al has a standard formation free energy smaller than those of the main components. As the above-described surface oxide coating is stably formed on the surface of the ground electrode, the oxidation phenomenon does not advance into the inside of the ground electrode. Thus, it becomes possible to secure excellent heat-resisting and oxidation-resisting properties for the ground electrode.

However, if the thickness is reduced, the ground electrode may be broken. For example, the ground electrode is subjected to severe vibrations in severe engine operating conditions. In this respect, the ground electrode must have sufficient breakage-resisting properties.

In view of the above problems, the present invention has an object to provide a spark plug capable of securing high ignitability even when the mixture flow velocity is high and also capable of assuring satisfactory heat-resisting properties and breakage-resisting properties when the ground electrode is thinned.

According to the inventor of this application, the state of crystal grains has important role in securing satisfactory breakage-resisting properties for a thinned ground electrode. It is needless to say that the strength of the ground electrode should be in a predetermined level.

In general, when recrystallization of the ground electrode occurs in high-temperature conditions, the crystal grain diameters of the ground electrode will increase and the strength of the ground electrode will reduce. Accordingly, increasing the crystal grain diameters is disadvantageous in assuring the breakage-resisting properties.

However, through enthusiastic efforts and activities in the research and development, the inventor of this application has obtained a result that, in a case that the ground electrode has excellent heat-resisting properties (i.e. when the ground electrode contains either Ni or Fe as a main component and at least one additive selected from the group consisting of Cr and Al), the ground electrode having small crystal grain diameters tends to be easily broken in high-temperature conditions.

Large engine vibrations and combustion pressures are main causes of breakages. The breakages chiefly occur at the bent portion of the ground electrode where a largest external force is applied. Upon investigation on breakages at the bent portion, the inventor has confirmed that breakages occur at the grain boundaries.

In general, in an ordinary temperature level sufficiently lower than the above high-temperature conditions, the intergranular strength is superior to the transgranular strength. When the grain diameters are small, a large number of grain boundaries are presents. Thus, when the crystal grain diameters are small, the ground electrode is strong enough and robust against breakages.

However, the bent portion of the ground electrode is subjected to relatively high temperatures during operations of the engine. Under such severe temperature conditions, the transgranular strength is superior to the intergranular strength. Thus, it can be concluded that having larger grain diameters is advantageous to have excellent breakage-resisting properties in high-temperature conditions.

Namely, according to the inventor of this application, having a large crystal structure at the bent portion is a key to assure excellent breakage-resisting properties in the high-temperature conditions. From the above inventor's knowledge and based on various analyses and evaluations, the present invention provides the following first to third spark plugs.

More specifically, the first spark plug of the present invention includes a metal housing, an insulator, a center electrode, and a ground electrode. The metal housing has a fixing screw portion provided on an outer surface thereof, so that the metal housing can be installed to an engine via the fixing screw portion. The insulator, fixed in the metal housing, has one end portion protruding from one end portion of the metal housing. The center electrode, fixed in an axial hole of the insulator, has one end portion protruding from one end portion of the insulator. The ground electrode has one end portion fixed to the metal housing, a bent portion provided at an intermediate portion thereof, and the other end portion positioned in a confronting relationship with one end portion of the center electrode to form a spark discharge gap.

The first spark plug of the present invention is characterized in that the ground electrode contains either Ni or Fe as a main component and at least one additive selected from the group consisting of Cr and Al, a cross-sectional area of the ground electrode is not less than 2 $mm^2$ and not greater than 3 $mm^2$, and an average value of crystal grain diameters in a thickness direction is not less than 100 μm at least at the bent portion.

The first spark plug of the present invention can secure excellent heat-resisting properties for the ground electrode, as the ground electrode contains either Ni or Fe as a main component and at least one additive selected from the group consisting of Cr and Al.

Furthermore, as the cross-sectional area of the ground electrode is not less than 2 $mm^2$ and not greater than 3 $mm^2$, the first spark plug of the present invention can secure high ignitability by reducing the cooling loss due to quenching effects at high mixture flow velocities and also can prevent the temperature from increasing steeply in the ground electrode.

Furthermore, as the average value of crystal grain diameters in the thickness direction is not less than 100 μm at least at the bent portion of the ground electrode, the first spark plug of the present invention can suppress breakages of the ground electrode even in severe temperature and vibration conditions during engine operations.

As described above, the first spark plug of the present invention can secure satisfactory heat-resisting properties and breakage-resisting properties for the ground electrode even when the ground electrode is thinned to secure high ignitability against high mixture flow velocities.

Furthermore, the second spark plug of the present invention includes a metal housing, an insulator, a center electrode, and a ground electrode. The metal housing has a fixing screw portion provided on an outer surface thereof, so that the metal housing can be installed to an engine via the fixing screw portion. The insulator, fixed in the metal housing, has one end portion protruding from one end portion of the metal housing. The center electrode, fixed in an axial hole of the insulator, has one end portion protruding from one end portion of the insulator. The ground electrode has one end portion fixed to the metal housing, a bent portion provided at an intermediate portion thereof, and the other end portion positioned in a confronting relationship with one end portion of the center electrode to form a spark discharge gap.

The second spark plug of the present invention is characterized in that the ground electrode contains either Ni or Fe as a main component and at least one additive selected from the group consisting of Cr and Al, a cross-sectional area of the ground electrode is not less than 2 $mm^2$ and not greater than 3 $mm^2$, an average value of crystal grain diameters in the thickness direction is not greater than 50 μm, and a height of the bent portion from one end portion of the metal housing is not less than 4 mm and not greater than 6.5 mm.

According to the second spark plug of the present invention, the ground electrode contains either Ni or Fe as a main component and at least one additive selected from the group consisting of Cr and Al, and the cross-sectional area of the ground electrode is not less than 2 $mm^2$ and not greater than 3 $mm^2$. Therefore, the second spark plug of the present invention brings the functions and effects substantially identical with those of the above-described first spark plug of the present invention.

Furthermore, according to the second spark plug of the present invention, although the average value of crystal grain diameters in the thickness direction at the ground electrode is not greater than 50 μm, the height of the bent portion from one end portion of the metal housing is not less than 4 mm and not greater than 6.5 mm.

The above-described range of the height is based on the result of analysis conducted by the inventor. Setting the above-described height brings the effect of suppressing the temperature increase of the ground electrode within a practical range. Furthermore, it becomes possible to increase the temperature of the bent portion during operations of the spark plug to a desirable temperature level so that the average value of crystal grain diameters in the thickness direction becomes equal to or greater than 100 μm.

Namely, according to the second spark plug of the present invention which regulates the height as described above, even if initial crystal grain diameters are small, recrystallization occurs at the bent portion when the spark plug is used in high-temperature engine operating conditions, and accordingly the crystal grain diameters become sufficiently larger to secure excellent breakage-resisting properties. Thus, the second spark plug of the present invention can secure sufficient breakage-resisting properties.

As described above, the second spark plug of the present invention can secure satisfactory heat-resisting properties and breakage-resisting properties for the ground electrode even when the ground electrode is thinned to secure high ignitability against high mixture flow velocities.

More specifically, the third spark plug of the present invention includes a metal housing, an insulator, a center electrode, and a ground electrode. The metal housing has a fixing screw portion provided on an outer surface thereof, so that the metal housing can be installed to an engine via the fixing screw portion. The insulator, fixed in the metal housing, has one end portion protruding from one end portion of the metal housing. The center electrode, fixed in an axial hole of the insulator, has one end portion protruding from one end portion of the insulator. The ground electrode has one end portion fixed to the metal housing, a bent portion provided at the intermediate portion thereof, and the other end portion positioned in a confronting relationship with one end portion of the center electrode to form a spark discharge gap.

The third spark plug of the present invention is characterized in that the ground electrode contains either Ni or Fe as a main component and at least one additive selected from the group consisting of Cr and Al, a cross-sectional area of the ground electrode is not less than 2 $mm^2$ and not greater than 3 $mm^2$, an average value of crystal grain diameters in the thickness direction is not greater than 50 μm, and the average value of crystal grain diameters in the thickness direction becomes equal to or greater than 100 μm at least at the bent portion of the ground electrode when the spark plug is used for 10 hours or more in an engine of 2000 cc under a condition that the rotational speed is 5600 rpm and the throttle is fully opened.

According to the third spark plug of the present invention, the ground electrode contains either Ni or Fe as a main component and at least one additive selected from the group consisting of Cr and Al, and the cross-sectional area of the ground electrode is not less than 2 $mm^2$ and not greater than 3 $mm^2$. Therefore, the third spark plug of the present invention brings the functions and effects substantially identical with those of the above-described first spark plug of the present invention.

Furthermore, according to the third spark plug of the present invention, although the average value of crystal grain diameters in the thickness direction at the ground electrode is not greater than 50 μm, the average value of crystal grain diameters in the thickness direction becomes equal to or greater than 100 μm at least at the bent portion of the ground electrode when the spark plug is used for 10 hours or more in an engine of 2000 cc under a condition that the rotational speed is 5600 rpm and the throttle is fully opened.

Namely, according to the third spark plug of the present invention, when the engine is operating in the severe thermal load conditions which may cause breakage of the ground electrode, recrystallization occurs at the bent portion of the ground electrode and accordingly the crystal grain diameters become sufficiently larger to secure excellent breakage-resisting properties. Thus, the third spark plug of the present invention can secure sufficient breakage-resisting properties.

As described above, the third spark plug of the present invention can secure satisfactory heat-resisting properties and breakage-resisting properties for the ground electrode even when the ground electrode is thinned to secure high ignitability against high mixture flow velocities.

According to the above-described first to third spark plugs of the present invention, it is preferable that the ground electrode contains Al by an amount not less than 0.5 weight % and not greater than 2 weight %, and also contains Cr by an amount not less than 18 weight % and not greater than 25 weight %.

Alternatively, according to the above-described first to third spark plugs of the present invention, it is preferable that the ground electrode contains Al by an amount not less than 2 weight % and not greater than 5 weight % and also contains Cr by an amount not less than 10 weight % and not greater than 18 weight %

Furthermore, according to the above-described first to third spark plugs of the present invention, it is preferable that the ground electrode contains a rare earth element. Adding the rare earth element, such as lanthanoids, to the ground electrode is effective in improving the heat-resisting properties of the ground electrode.

Furthermore, according to the above-described first to third spark plugs of the present invention, it is preferable that a bending angle of the bent portion is equal to or less than 100°.

The present invention is based on the result of analysis conducted by the inventor. When the bending angle is large, the flame kernel may contact with the ground electrode and cause quenching effects. As a result, the ignitability is lessened. However, setting the bending angle to be equal to or less than 100° makes it possible to secure adequate ignitability.

Furthermore, according to the above-described first to third spark plugs of the present invention, it is preferable that the fixing screw portion is M10 or less according to the Japanese Industrial Standard.

According to the spark plug having the fixing screw portion of M10 or less, the ground electrode has a sufficiently thin thickness. Hence, it becomes possible to obtain appropriate effects by employing the above-described arrangements.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
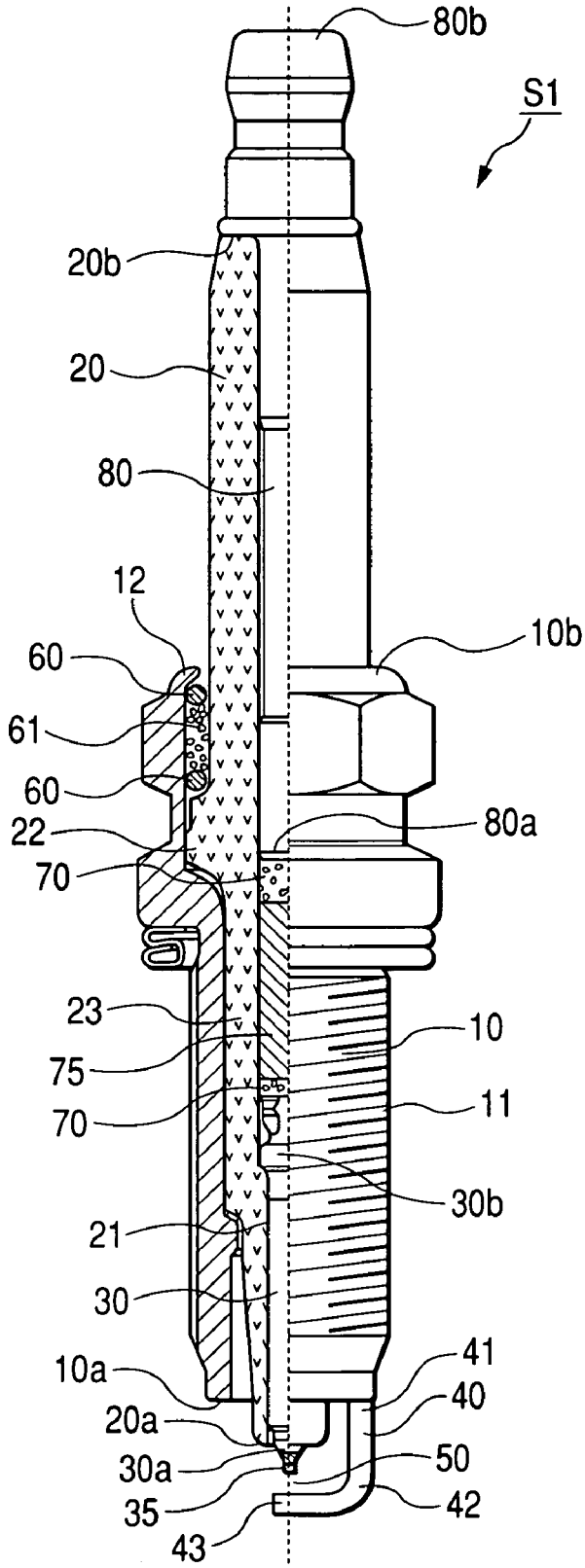
FIG. 1 is a half cross-sectional view showing an overall arrangement of a spark plug in accordance with a first embodiment of the present invention.

Hereinafter, preferred embodiments of the present invention will be explained with reference to attached drawings. In the drawings, the same or equivalent portions or members are denoted by the same reference numerals.

First Embodiment

Figure 2A:
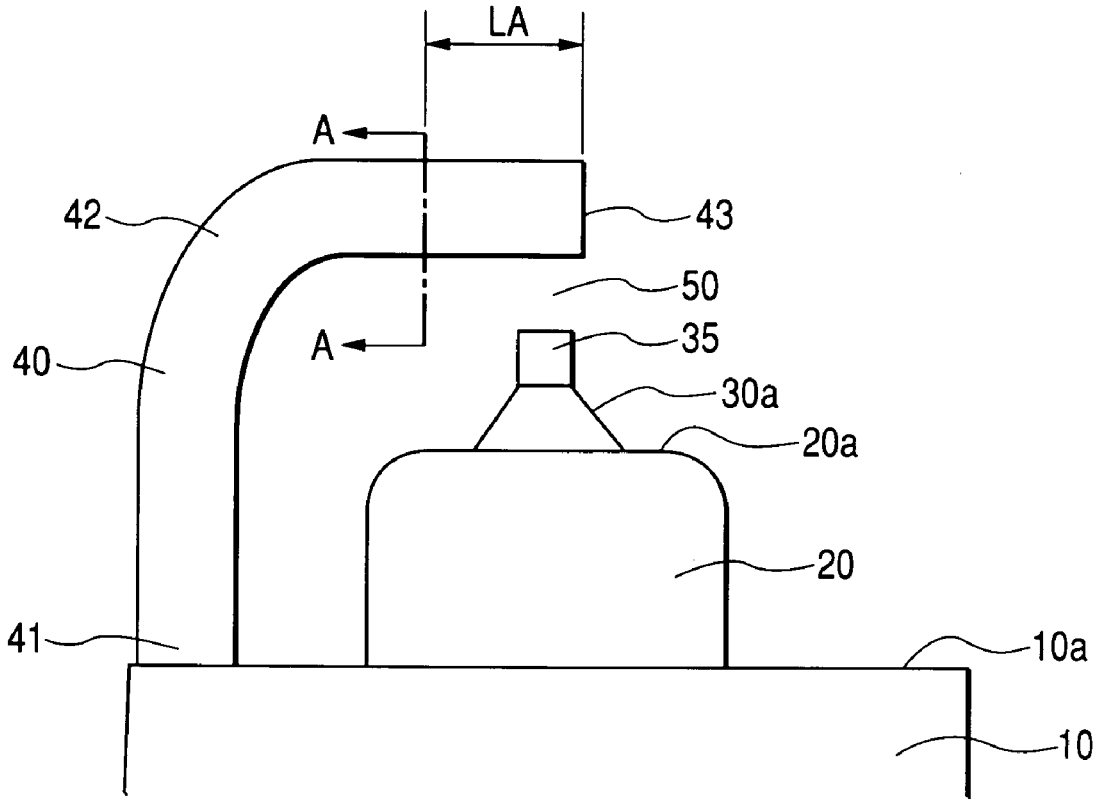
FIG. 2A is an enlarged side view showing an igniting portion of the spark plug shown in FIG. 1.
Figure 2B:
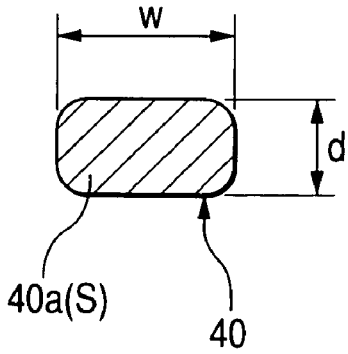
FIG. 2B is a cross-sectional view showing the spark plug, taken along a line A—A of FIG. 2A.

FIG. 1 is a half cross-sectional view showing an overall arrangement of a spark plug S1 in accordance with a first embodiment of the present invention. FIG. 2A is an enlarged side view showing an igniting portion of the spark plug S1 shown in FIG. 1. FIG. 2B is a cross-sectional view showing the spark plug S1, taken along a line A—A of FIG. 2A.

Arrangement of Spark Plug

The spark plug S1 is preferably applicable to an automotive engine as an ignition plug which is inserted and fixed in a screw hole provided in an engine head (not shown) defining therein a combustion chamber.

The spark plug S1 includes a cylindrical metal housing 10 made of an electrically conductive steel plate (e.g. low-carbon steel). A fixing screw portion 11 is provided on an outer cylindrical surface of the metal housing 10, so that the metal housing 10 can be fixed to an engine block (not shown). According to this embodiment, the fixing screw portion 11 is M10 or less according to JIS (i.e. Japanese Industrial Standard).

An insulator 20, made of almina ceramic ($Al_2O_3$) or the like, is accommodated and fixed in the metal housing 10. The insulator 20 has one end portion 20*a* protruding from one end portion 10*a* of the metal housing 10.

A center electrode 30 is fixed in an axial hole 21 of the insulator 20, so that the center electrode 30 can be held in an insulated condition relative to the metal housing 10.

For example, the center electrode 30 is a columnar member consisting of an inner material arranged by Cu or other metallic material having excellent thermal conductivity and an outer material arranged by a Ni-based alloy or other metallic material having excellent heat-resisting and ant-corrosion properties.

As shown in FIG. 1, the center electrode 30 has one end portion 30*a* protruding from one end portion 20*a* of the insulator 20. Thus, the center electrode 30 is held in an insulated condition relative to the metal housing 10, with one end portion 30*a* protruding from one end portion 10*a* of the metal housing 10.

Furthermore, the ground electrode 40 is a pillar member containing either Ni or Fe as a main component and at least one additive selected from the group consisting of Cr and Al.

According to this embodiment, to secure heat-resisting properties for the ground electrode 40, the ground electrode 40 contains either Ni or Fe as a main component and at least one additive selected from the group consisting of Cr and Al.

As described above, in high-temperature engine operating conditions, additive elements having relatively small standard formation free energies are easily oxidized than the main components having relatively large standard formation free energies. Accordingly, the additive elements shift toward the surface of the ground electrode 40 and form surface oxides there.

Namely, adding Cr or Al as additive elements to the ground electrode enables the ground electrode to form a stable surface oxide layer (i.e. coating layer) of the additive elements on the surface, as each of Cr or Al has a standard formation free energy smaller than those of the main components. As the above-described surface oxide coating is stably formed on the surface of the ground electrode, the oxidation phenomenon does not advance into the inside of the ground electrode. Thus, it becomes possible to secure excellent heat-resisting and oxidation-resisting properties for the ground electrode 40.

More specifically, the ground electrode 40 contains Al by an amount not less than 0.5 weight % and not greater than 2 weight %, and also contains Cr by an amount not less than 18 weight % and not greater than 25 weight %. Alternatively, the ground electrode 40 contains Al by an amount not less than 2 weight % and not greater than 5 weight % and also contains Cr by an amount not less than 10 weight % and not greater than 18 weight %

Furthermore, the ground electrode 40 of this embodiment has one end portion 41 being fixed by welding to one end portion 10*a* of the metal housing 10, a bent portion 42 being bent into an L-shaped configuration at the intermediate portion, and the other end portion 43 positioned in a confronting relationship with one end portion 30*a* of the center electrode 30 to form a spark discharge gap 50.

According to this embodiment, a noble metallic tip 35 is bonded on one end portion 30*a* of the center electrode 30 by laser welding or resistance welding. The noble metallic tip 35 serves as a spark discharging member. For example, the noble metallic tip 35 is a columnar member made of a Pt alloy or an Ir alloy. The spark discharge gap 50 is a clearance (i.e. gap) between a distal end portion of the noble metallic tip 35 and the other end portion 43 of the ground electrode 40 (more specifically, a side surface of the end portion 43 facing to the spark discharge gap 50).

Figure 3:
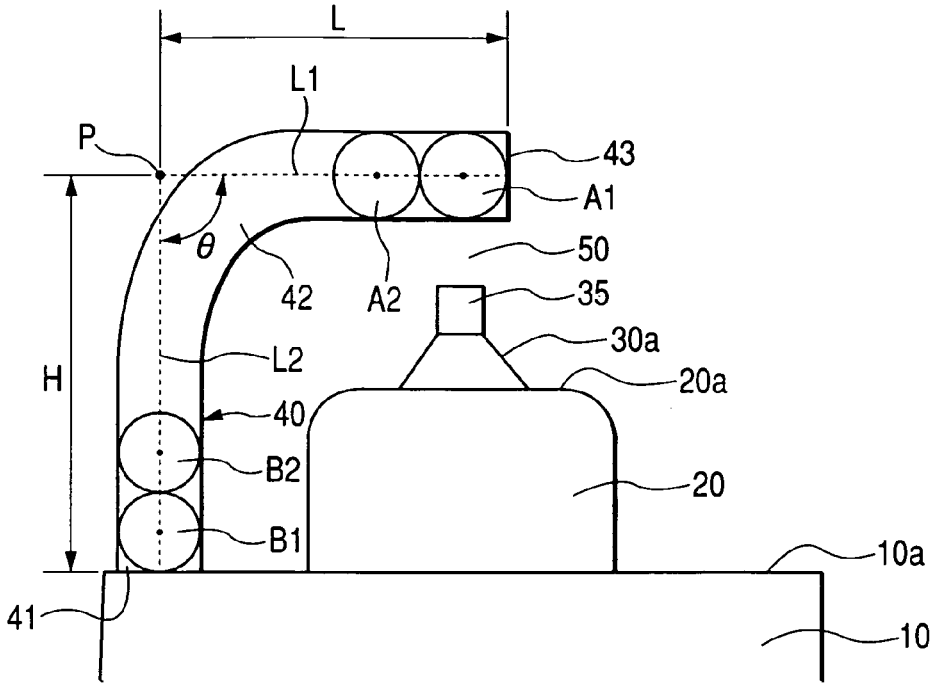
FIG. 3 is a view explaining dimensions L and H of a ground electrode of the spark plug in accordance with the first embodiment of the present invention.

Dimensions of the ground electrode 40 will be explained with reference to FIGS. 2A, 2B and 3. FIG. 3 is a view explaining dimensions L and H of the ground electrode 40 of the spark plug S1.

According to this embodiment, an area S (i.e. a cross-sectional area S) of a cross section 40*a* of the ground electrode 40 shown in FIG. 2B is not less than 2 $mm^2$ and not greater than 3 $mm^2$. According to the example shown in FIG. 2B, the ground electrode 40 is a square pole having a rectangular cross section. For example, the ground electrode 40 has thickness 'd' of 1.15 mm and width 'w' of 2.2 mm.

Furthermore, FIG. 3 shows a height H of the bent portion 42 of the ground electrode 40 from one end portion 10*a* (i.e. front end surface 10*a*) of the metal housing 10 and a length L from the bent portion 42 to the front end surface of the other end portion 43.

As shown in FIG. 3, a circle A1 is a virtual circle tangent to each of the front end surface of the other end portion 43 of the ground electrode 40, the side surface of the other end portion 43 facing to the spark discharge gap 50, and the opposite side surface of the other end portion 43 of the spark discharge gap 50. A circle A2 is a virtual circle tangent to the circle A1 and both of the side surfaces of the other end portion 43. A virtual line L1 passes the centers of these circles A1 and A2.

On the other hand, as shown in FIG. 3, a circle B1 is a virtual circle tangent to a boundary surface between the ground electrode 40 and the metal housing 10, a side surface of one end portion 41 facing to the spark discharge gap 50, and the opposite side surface of one end portion 41. A circle B2 is a virtual circle tangent to the circle B1 and both of the side surfaces of one end portion 41. A virtual line L2 passes the centers of these circles B1 and B2.

Two virtual lines L1 and L2 intersect at a point P. The angle formed between these virtual lines L1 and L2 is defined as a bending angle θ of the bent portion 42. It is desirable that the bending angle θ is equal to or less than 100°.

Furthermore, the height H of the bent portion 42 of the ground electrode 40 from the front end surface 10*a* of the metal housing 10 is defined as representing a distance from the intersecting point P to the front end surface 10*a* of the metal housing 10. Furthermore, the length L from the bent portion 42 of the ground electrode 40 to the front end surface of the other end portion 43 is defined as representing a distance from the intersecting point P to the front end surface of the other end portion 43. The length L is in a range from 3 mm to 5 mm.

Figure 4:
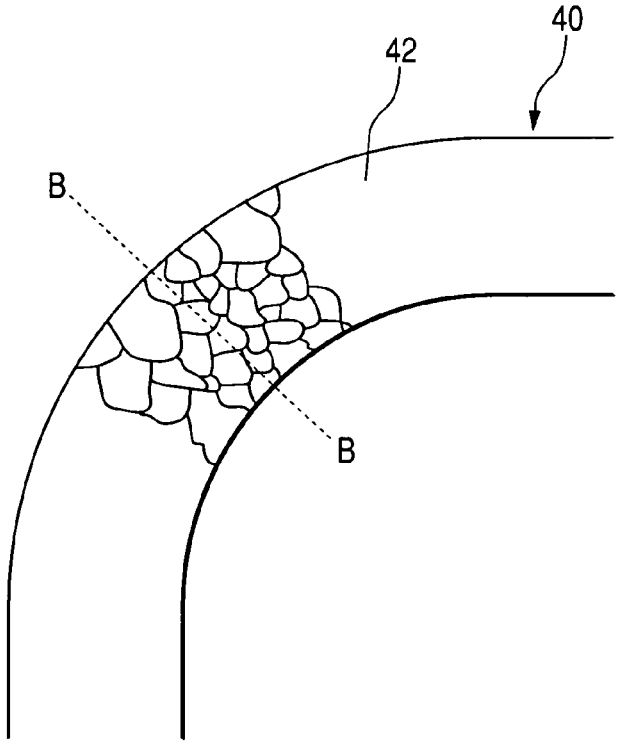
FIG. 4 is an enlarged cross-sectional view showing a bent portion of the ground electrode of the spark plug in accordance with the first embodiment of the present invention.

Furthermore, FIG. 4 is an enlarged cross-sectional view showing the bent portion 42 of the ground electrode 40 in accordance with this embodiment. The microscope observation applied to a cut surface reveals the crystal structure of metals arranging the ground electrode 40.

According to this embodiment, an average value D of crystal grain diameters in the thickness direction is not less than 100 μm at least at the bent portion 42 of the ground electrode 40. More specifically, it is possible to observe numerous crystal grains arrayed along a place indicated by the line B—B in FIG. 4. These numerous crystal grains have grain diameters, and the average value D of the grain diameters is equal to or greater than 100 μm. The line B—B represents a line extending from the intersecting point P and dividing the bending angle θ into the same angles.

For example, the average grain diameter D can be obtained by using the following method. First of all, the ground electrode 40 is cut along the longitudinal axis so that a bare cut surface is formed as shown in FIG. 4.

Then, the bare cut surface of the ground electrode 40 is treated by etching fluid such as oxalic acid to visualize grain boundaries. Then, with respect to the crystal grains arrayed along the line B—B on the treated cut surface, grain diameters are measured through the microscope observation. Then, the average value D of crystal grain diameters is calculated based on the measured grain diameters of these crystal grains.

For example, applying a heat treatment to the ground electrode 40 to cause recrystallization makes it possible to obtain crystal grain diameters having the average value D not less than 100 μm in the thickness direction at least at the bent portion 42 of the ground electrode 40. When the heat treatment temperature is high, the average value D of crystal grain diameters in the thickness direction tends to become larger.

Furthermore, as shown in FIG. 1, according to the spark plug S1 of this embodiment, the insulator 20 is inserted in the metal housing 10. The metal housing 10 has a caulking portion 12 formed at the other end portion 10*b*. The insulator 20 and the metal housing 10 are fixed together by deforming the caulking portion 12.

Furthermore, at this caulking portion 12, two metallic members 60 and talc 61 are positioned between the metal housing 10 and the insulator 20 so as to cooperatively seal the clearance between the metal housing 10 and the insulator 20. The talc 61 interposes between two metallic rings 60.

Furthermore, as shown in FIG. 1, the insulator 20 has a barrel portion 22 where the diameter of the insulator 20 is maximized. Namely, the barrel portion 22 of the insulator 20 is located in the metal housing 10 as a stepped portion having the maximum diameter.

Providing such a stepped portion (i.e. barrel portion 22) is effective in realizing the caulking operation since the metallic members 60 and talc 61 can be surely held between the caulking portion 12 and the barrel portion 22.

Furthermore, the insulator 20 has a sublevel portion 23 extending from the barrel portion 22 toward one end portion 20*a* in the metal housing 10. The sublevel portion 23 has a diameter smaller than that of the barrel portion 22. In other words, there is a step (i.e. a radial difference) between the barrel portion 22 and the sublevel portion 23.

As described above, the insulator 20 has the barrel portion 22 for ensuring the caulking fixation of metal housing 10 and for stably holding the seal members. Furthermore, the diameter of insulator 20 is thinned at the sublevel portion 23 positioned next to the barrel portion 22 which extends toward one end portion 20*a* of the insulator 20 (i.e. toward the spark discharging portion).

Furthermore, as shown in FIG. 1, in the axial hole 21 of insulator 20, the other end portion 30*b* of the center electrode 30 is electrically connected to a resistance element 75 via an electrically conductive glass seal member 70.

Furthermore, as shown in FIG. 1, the resistance element 75 is electrically connected to one end portion 80*a* of a terminal electrode (i.e. stem) 80 via an electrically conductive glass seal member 70 in the axial hole 21 positioned closely to the other end portion 20*b* of insulator 20.

The other end portion 80*b* of the terminal electrode 80 protrudes out of the other end portion 20*b* of insulator 20. An ignition coil (not shown) is connected to the other end portion 80*b* of terminal electrode 80.

Dimensional Relationships

According to this embodiment, the cross-sectional area S of the ground electrode 40 is in a range not less than 2 $mm^2$ and not greater than 3 $mm^2$, and the average value D of crystal grain diameters in the thickness direction is not less than 100 μm at least at the bent portion 42 of the ground electrode 40. The dimensional relationship of the above-described embodiment is based on inventor's analysis and experimental results.

Figure 5:
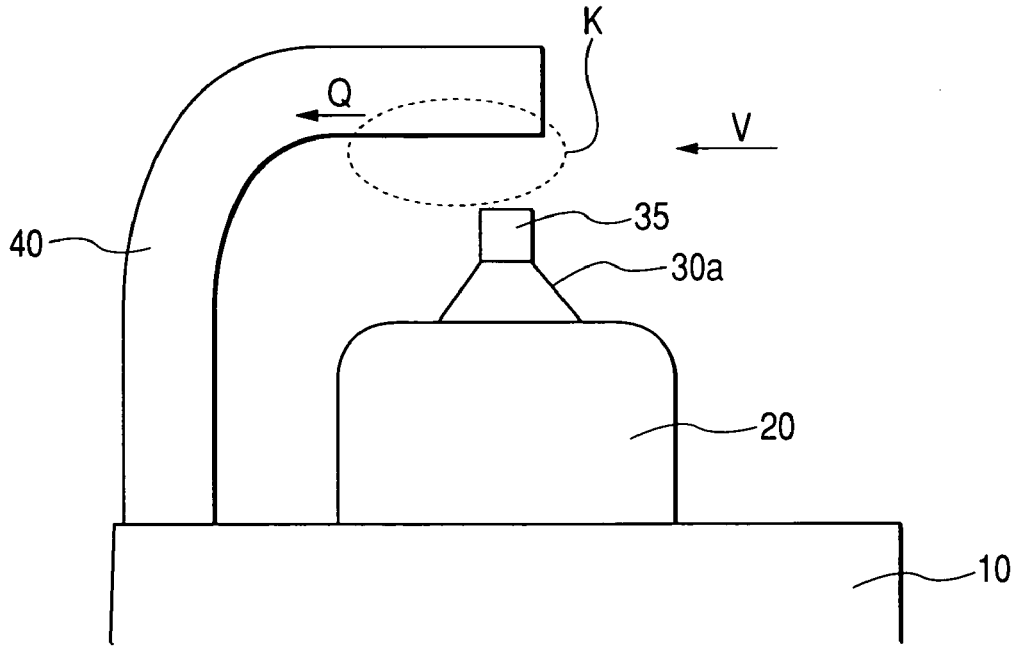
FIG. 5 is a view schematically explaining a relationship between mixture flow velocity V and flame kernel K in a spark plug.

First of all, the inventor has obtained a relationship between mixture flow velocity and ignitability. FIG. 5 is a view schematically explaining a relationship between mixture flow velocity V and flame kernel K in a spark plug. When the mixture flow velocity V is high, the flame kernel K possibly contacts with the ground electrode 40 and causes quenching effects. The ignitability is lessened.

In view of the above, the inventor has analyzed the relationship among the mixture flow velocity V, the cross-sectional area S (refer to FIG. 2B) of ground electrode 40, and the ignitability. In this case, the cross-sectional area S of ground electrode 40 is a cross-sectional area of the ground electrode 40 at distance LA (refer to FIG. 2A) of 2 mm from the front end surface of the other end portion 43

Figure 6:
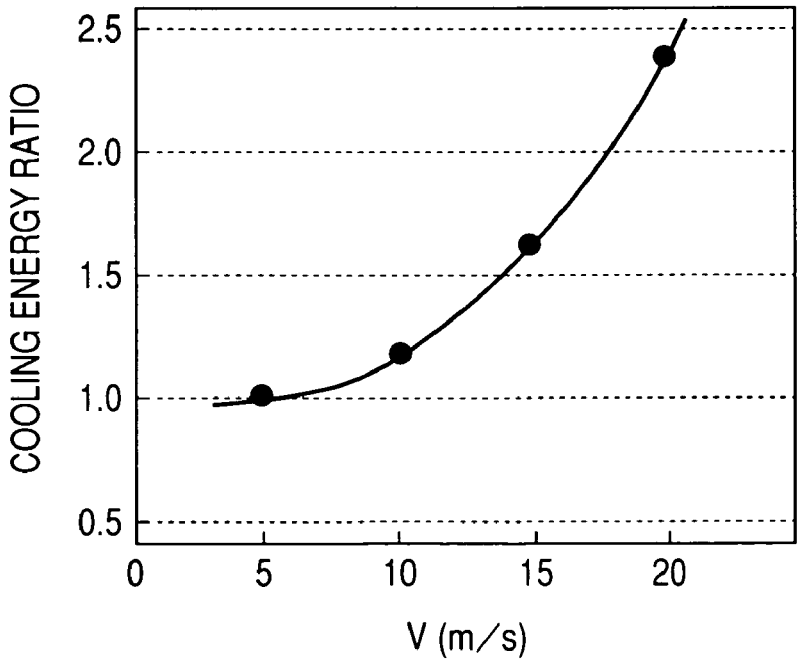
FIG. 6 is a graph showing a relationship between the mixture flow velocity V and a cooling energy.
Figure 7:
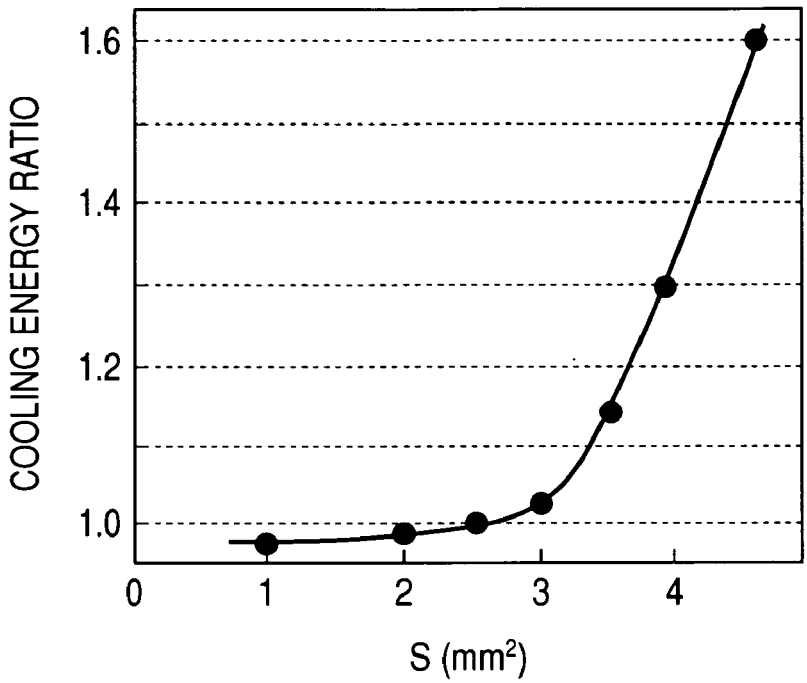
FIG. 7 is a graph showing a relationship between a cross-sectional area S of the ground electrode and the cooling energy.

The inventor has analyzed a cooling energy Q at the ground electrode 40 (i.e. energy loss caused when the flame kernel K is cooled by the ground electrode 40), assuming a mixture flow velocity V at which the ignitability is most worsened, i.e. the flow velocity V at which the flame kernel K is brought into contact with the ground electrode 40. FIGS. 6 and 7 show the result of this analysis.

FIG. 6 is a graph showing a relationship between the mixture flow velocity V and the cooling energy. FIG. 7 is a graph showing a relationship between a cross-sectional area S of ground electrode 40 and the cooling energy. In these FIGS. 6 and 7, the cooling energy is expressed in terms of relative ratio, i.e. cooling energy ratio.

As shown in FIG. 6, when the mixture flow velocity V is large, the flame kernel K tends to contact with the ground electrode 40 and accordingly the cooling energy Q becomes larger. In other words, the effect of cooling loss becomes larger and the ignitability is lessened when the mixture flow velocity V increases.

According to conventional engines, the mixture flow velocity V is approximately 5 m/s. On the other hand, recent advanced engines have the mixture flow velocity V of approximately 15 m/s. The cooling energy is 1.5 times the conventional value.

Furthermore, as shown in FIG. 7, the cooling energy becomes larger with increasing cross-sectional area S of the ground electrode 40. When the cross-sectional area S of ground electrode 40 is less than 3 $mm^2$, the effect of cooling loss becomes smaller and accordingly the ignitability can be secured adequately.

Furthermore, if the ground electrode 40 is too much thin, the temperature will increase greatly at the front end portion of ground electrode 40, i.e. at the other end portion 43, up to approximately 1100° C.

If the temperature is increased up to 1100° C., irregular ignition phenomenon (i.e. so-called preignition) will occur at the front end portion of ground electrode 40 prior to the regular ignition occurring in the spark discharge gap 50. Such irregular ignitions possibly damage the engine.

According to conventional spark plugs, the cross-sectional area S of ground electrode 40 is approximately 4.4 $mm^2$. In this case, the front end temperature will increase up to 1000° C. at maximum in ordinary engine operating conditions. Regarding the dimensions of ground electrode 40, the thickness 'd' is 1.6 mm and the width 'w' is 2.8 mm (refer to FIG. 2B).

Figure 8:
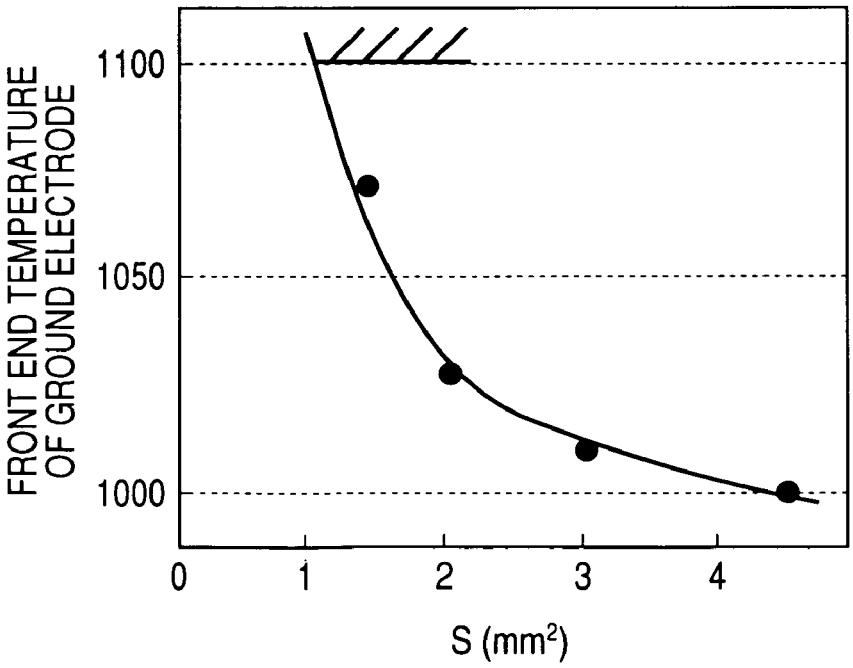
FIG. 8 is a graph showing a relationship between the cross-sectional area S of the ground electrode and a front end temperature of the ground electrode.

The inventor has obtained a relationship between the cross-sectional area S of ground electrode 40 and the front end temperature of ground electrode 40 according to a temperature analysis using the finite-element method. FIG. 8 shows the result of this analysis. As shown in FIG. 8, when the cross-sectional area S of ground electrode 40 is less than 2 $mm^2$, the front end temperature of ground electrode 40 increases steeply.

From the result of analyses shown in FIG. 6 to FIG. 8, when the cross-sectional area S of the ground electrode 40 is not less than 2 mm and not greater than 3 $mm^2$, it is understood that the effect of cooling loss due to quenching effects at high mixture flow velocities can be reduced and accordingly high ignitability can be secured without causing steep temperature increase at the ground electrode 40. This is the reason why the cross-sectional area S of the ground electrode 40 is set to be not less than 2 $mm^2$ and not greater than 3 $mm^2$ in this embodiment.

Furthermore, as described above, to secure heat-resisting properties for the ground electrode 40 in high-temperature conditions, e.g. at the temperature level exceeding 1000° C., it is effective that the ground electrode 40 contains Ni or Fe as a main component and Cr or Al as an additive.

Hence, the inventor has conducted evaluations with respect to breakage-resisting properties of the ground electrode 40 which has the cross-sectional area S of 2.5 $mm^2$ (equivalent to thickness d=1.15 mm and width w=2.2 mm) and uses a material of Ni-15 wt % Cr-2.5 wt % Al.

Figure 9:
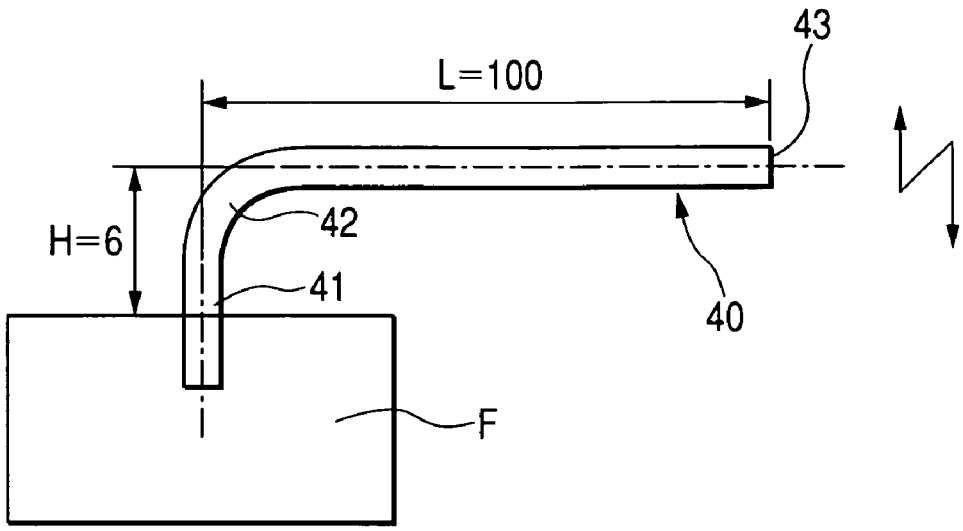
FIG. 9 is a view explaining a method for evaluating breakage-resisting properties.

FIG. 9 is a view explaining a method for evaluating breakage-resisting properties of the ground electrode 40. As shown in FIG. 9, as an acceleration evaluation, a large force is applied to the bent portion 42 by using a vibrator F (having a testing power of 10 G). The length L of the tested ground electrode is set to 100 mm, although the length L of a practical ground electrode is usually in a range from 3 mm to 5 mm. Furthermore, the tested ground electrode has the height H of 6 mm.

Furthermore, the temperature of the ground electrode 40, at the region from the front end portion 43 to the bent portion 42, is increased up to 900° C. by using a gas burner to realize engine operating conditions.

Then, as shown in FIG. 9, one end portion 41 of ground electrode 40 is fixed to the vibrator F. By adjusting the frequency (e.g. 60 Hz) of the vibrator F, the front end portion 43 is vibrated to forcibly cause breakages.

Then, the inventor has evaluated the breakage-resisting properties of the ground electrode 40 by changing the average value D of crystal grain diameters in the thickness direction at the bent portion 42. For example, the crystal grain diameters can be changed by adjusting heat treatment conditions to evaluation the breakage-resisting properties.

More specifically, evaluations of the breakage-resisting properties of the ground electrode 40 were conducted at 30 μm, 75 μm, 100 μm, and 160 μm of the average value D of crystal grain diameters. The average value D of crystal grain diameters of the ground electrode 40 is initially 30 μM, and becomes 75 μm when the ground electrode 40 is subjected to a 30-minute heat treatment at 850° C. Furthermore, the average value D of crystal grain diameters of the ground electrode 40 becomes 100 μm when subjected to a 30-minute heat treatment at 900° C., and becomes 160 μm when subjected to a 30-minute heat treatment at 1000° C.

The following Table 1 shows the evaluation result with respect to the breakage-resisting properties of the ground electrode 40. More specifically, Table 1 shows the presence of breakages in relation to the average value D of crystal grain diameters in the thickness direction at the bent portion 42 of ground electrode 40. Regarding the "presence of breakage" in Table 1, the sign X represents occurrence of breakages and the sign ○ represents no occurrence of breakages.

TABLE 1

| D | 30 | 75 | 100 | 160 |
|---|---|---|---|---|
| Presence of Breakages | X | X | ○ | ○ |

As shown in Table 1, when the average value D of crystal grain diameters in the thickness direction at the bent portion 42 of the ground electrode 40 is not less than 100 μm, no breakage occurs.

From the above evaluation result, this embodiment applies a heat treatment to increase the temperature of the ground electrode 40 up to 900° C. or more, so that the average value D of crystal grain diameters in the thickness direction becomes equal to or greater than 100 μm at least at the bent portion 42 of the ground electrode 40.

According to this embodiment, it is required to satisfy the condition that the average value D of crystal grain diameters in the thickness direction is not less than 100 μm, at least at the bent portion 42 of the ground electrode 40 which is relatively weak and tends to cause breakages. It is however preferable that the above condition (D≧100 μm) is satisfied in the entire region of the ground electrode 40. It is of course acceptable that the above condition (D≧100 μm) is satisfied only at the bent portion 42.

Effects

The spark plug S1 of this embodiment includes the metal housing 10 having the fixing screw portion 11 provided on the outer surface thereof so as to be installed to an engine via the fixing screw portion 11. The insulator 20, fixed in the metal housing 10, has one end portion 20*a* protruding from one end portion 10*a* of the metal housing 10. The center electrode 30, fixed in the axial hole 21 of the insulator 20, has one end portion 30*a* protruding from one end portion 20*a* of the insulator 20. The ground electrode 40 has one end portion 41 fixed to the metal housing 10, the bent portion 42 provided at the intermediate portion thereof, and the other end portion 43 positioned in a confronting relationship with one end portion 30*a* of the center electrode 30 to form the spark discharge gap 50.

The spark plug S1 of this embodiment is characterized in that the ground electrode 40 contains either Ni or Fe as a main component and at least one additive selected from the group consisting of Cr and Al. The cross-sectional area S of the ground electrode 40 is not less than 2 $mm^2$ and not greater than 3 $mm^2$. And, the average value D of crystal grain diameters in the thickness direction is not less than 100 μm at least at the bent portion 42.

Thus, the spark plug S1 of this embodiment can secure excellent heat-resisting properties for the ground electrode 40 and also can secure adequate strength for the ground electrode 40, as the ground electrode 40 contains either Ni or Fe as a main component and at least one additive selected from the group consisting of Cr and Al.

Furthermore, as the cross-sectional area S of the ground electrode 40 is not less than 2 $mm^2$ and not greater than 3 $mm^2$, the spark plug S1 of this embodiment can secure high ignitability by reducing the cooling loss due to quenching effects at high mixture flow velocities and also can prevent the temperature from increasing steeply in the ground electrode 40.

Furthermore, as the average value D of crystal grain diameters in the thickness direction is not less than 100 μm at least at the bent portion 42 of the ground electrode 40, the spark plug S1 of this embodiment can suppress breakages of the ground electrode 40 even in severe temperature and vibration conditions during engine operations.

As described above, the spark plug S1 of this embodiment can secure satisfactory heat-resisting properties and breakage-resisting properties for the ground electrode 40 even when the ground electrode 40 is thinned to secure high ignitability against high mixture flow velocities.

Furthermore, according to this embodiment, the ground electrode 40 contains Al by an amount not less than 0.5 weight % and not greater than 2 weight %, and also contains Cr by an amount not less than 18 weight % and not greater than 25 weight %. It is also preferable that the ground electrode 40 contains Al by an amount not less than 2 weight % and not greater than 5 weight % and also contains Cr by an amount not less than 10 weight % and not greater than 18 weight %

As described above, adding both of Cr and Al is effective to secure sufficient heat-resisting properties. However, excessively adding these elements will worsen workability of the ground electrode 40, for example, in forming a gap. Especially, the amount of added Al gives large effect on the workability. Hence, it is preferable that the ground electrode 40 has the above-described composition, when the heat-resisting properties and the workability are taken into consideration.

Furthermore, according to this embodiment, it is preferable that the ground electrode 40 contains rare earth elements, such as Sc, Y, and lanthanoids. When the ground electrode 40 contains a small amount of (e.g. 0.5 weight %) lanthanoids or other rare earth elements, the heat-resisting properties of ground electrode 40 can be improved.

Furthermore, according to the above-described embodiment, it is preferable that the bending angle θ (refer to FIG. 3) of the bent portion 42 of ground electrode 40 is equal to or less than 100°.

This is based on the result of analysis conducted by the inventor. When the bending angle θ is large, the flame kernel K tends to contact with the ground electrode 40 and causes quenching effects. The ignitability will be lessened.

Figure 10:
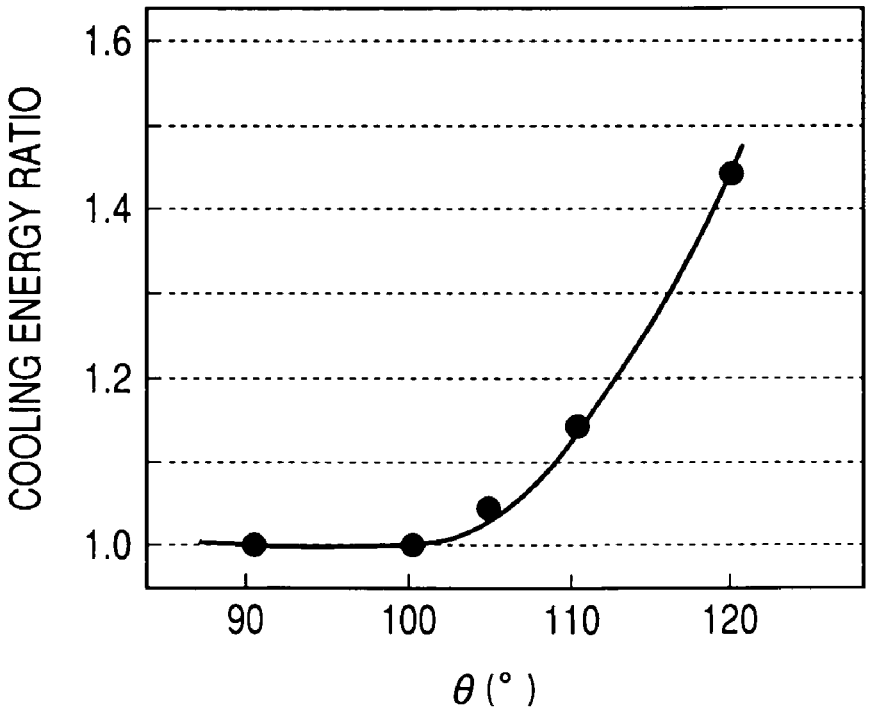
FIG. 10 is a graph showing a relationship between a bending angle θ of the bent portion and the cooling energy.

The inventor has conducted the above analysis based on the ground electrode 40 having the cross-sectional area S of 2.5 $mm^2$ (corresponding to a ground electrode having thickness d=1.15 mm and width w=2.2 mm) at the mixture flow velocity V of 15 m/s. FIG. 10 shows the result of this analysis.

FIG. 10 is a graph showing a relationship between the above-described bending angle θ and the cooling energy. In FIG. 10, the cooling energy is expressed in terms of relative ratio, i.e. cooling energy ratio.

As shown in FIG. 10, when the bending angle θ exceeds 100°, the cooling energy Q becomes larger greatly. Hence, it is preferable that the bending angle θ is equal to or less than 100°. Setting the bending angle θ to be equal to or less than 100° makes it possible to secure adequate ignitability.

If the gap formation of the ground electrode 40 is performed to excessively reduce the bending angle θ, the bent portion 42 may cause cracks due to large deformation. Hence, it is desirable that the bending angle θ is equal to or greater than 80°.

Second Embodiment

A spark plug in accordance with a second embodiment of the present invention will be explained with reference to the drawings used for explaining the first embodiment. Hereinafter, differences between the first and second embodiments will be explained in detail.

The spark plug of the second embodiment includes the metal housing 10 having the fixing screw portion 11 provided on the outer surface thereof so as to be installed to an engine via the fixing screw portion 11. The insulator 20, fixed in the metal housing 10, has one end portion 20*a* protruding from one end portion 10*a* of the metal housing 10. The center electrode 30, fixed in an axial hole 21 of the insulator 20, has one end portion 30*a* protruding from one end portion 20*a* of the insulator 20. The ground electrode 40 has one end portion 41 fixed to the metal housing 10, the bent portion 42 provided at the intermediate portion thereof, and the other end portion 43 positioned in a confronting relationship with one end portion 30*a* of the center electrode 30 to form the spark discharge gap 50.

The spark plug of the second embodiment is characterized in that the ground electrode 40 contains either Ni or Fe as a main component and at least one additive selected from the group consisting of Cr and Al. The cross-sectional area S of the ground electrode 40 is not less than 2 $mm^2$ and not greater than 3 $mm^2$. The average value D of crystal grain diameters in the thickness direction is not greater than 50 μm. And, the height H of the bent portion 42 from one end portion 10*a* of the metal housing 10 is not less than 4 mm and not greater than 6.5 mm.

As the ground electrode 40 contains either Ni or Fe as a main component and at least one additive selected from the group consisting of Cr and Al, and the cross-sectional area S of the ground electrode 40 is not less than 2 $mm^2$ and not greater than 3 $mm^2$, the spark plug of the second embodiment brings the functions and effects substantially identical with those of the spark plug S1 of the first embodiment.

Furthermore, according to the spark plug of the second embodiment, the ground electrode 40 satisfies the condition that the height H of the bent portion 42 from one end portion 10*a* of the metal housing 10 is not less than 4 mm and not greater than 6.5 mm, although the average value D of crystal grain diameters in the thickness direction is not greater than 50 μm.

The above-described range of the height H is based on the result of analysis conducted by the inventor.

Regarding the crystal grain diameters of the ground electrode 40 in the thickness direction, a smaller average value D will be acceptable in an initial condition, if the average value D can be later increased to a required value, i.e. 100 μm or more, due to recrystallization at the bent portion 42 which is heated during engine operations. In fact, breakages of the ground electrode 40 occur at high-speed/high-load engine operating conditions. In such severe conditions, the ground electrode 40 has high temperatures.

Hence, the inventor has conducted the following analysis according to the finite-element method with the above-described height H as a variable parameter.

As described above, to suppress occurrence of preignition, it is necessary to prevent the temperature of the front end portion 43 of ground electrode 40 (i.e. front end temperature) from exceeding 1100° C. In general, when the ground electrode 40 has a longer length L or when the ground electrode 40 has a smaller cross-sectional area S, the ground electrode 40 has poor heat-dissipating properties and accordingly the front end temperature tends to increase.

Figure 11:
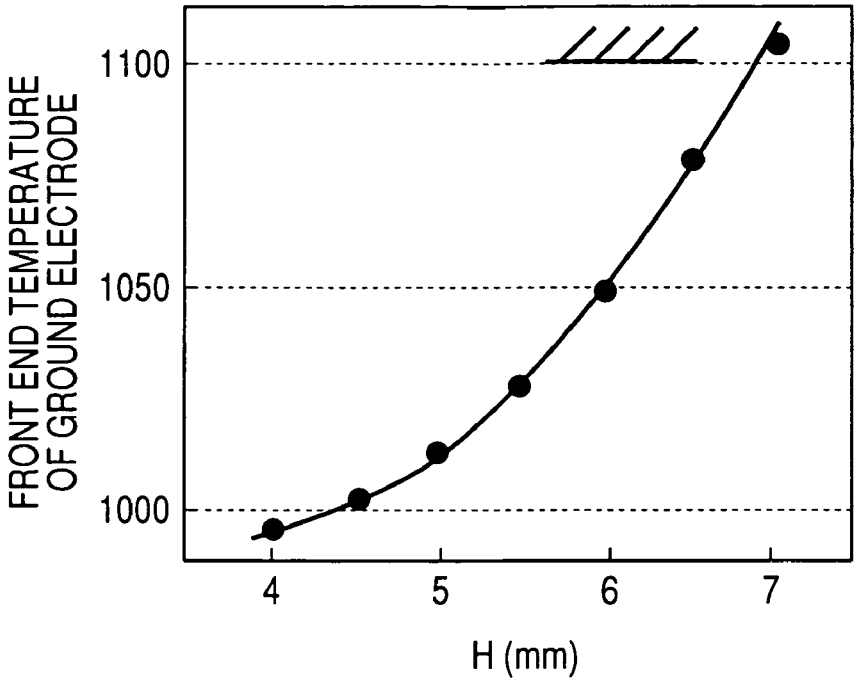
FIG. 11 is a graph showing a relationship between the height H and the front end temperature of the ground electrode.

Hence, the inventor has conducted the analysis based on a spark plug of this embodiment which has the length L of 5 mm and the cross-sectional area S of 2 $mm^2$ (as representative dimensions causing severe temperature increase at the front end of the ground electrode). FIG. 11 shows the result of this analysis.

FIG. 11 is a graph showing a relationship between the height H and the front end temperature of the ground electrode. As shown in FIG. 11, it is understood that the front end temperature of the ground electrode increases when the height H becomes larger. When the height H is equal to or less than 6.5 mm, the front end temperature does not exceed 1100° C.

On the other hand, when the temperature of the bent portion 42 (i.e. bent portion temperature) is equal to or higher than 900° C., recrystallization occurs at the bent portion 42 of ground electrode 40 and accordingly it becomes possible to set the average value D of crystal grain diameters in the thickness direction to be not less than 100 μm at the bent portion 42. When length L is shorter, or when cross-sectional area S is larger, the ground electrode 40 has excellent heat-dissipating properties and accordingly the bent portion temperature does not increase so much.

Figure 12:
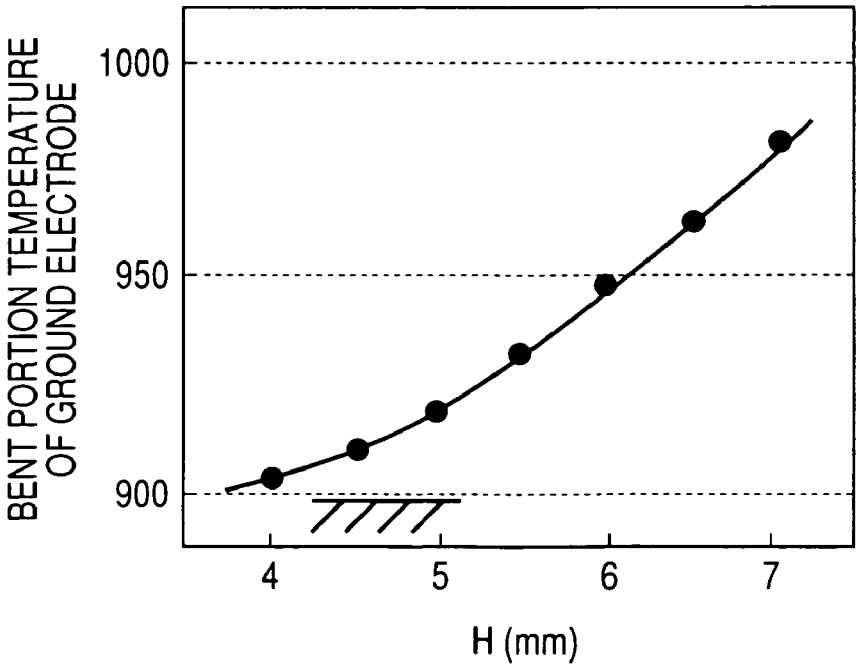
FIG. 12 is a graph showing a relationship between the height H and a bent portion temperature of the ground electrode.

Hence, the inventor has conducted the analysis based on a spark plug of this embodiment which has the length L of 3 mm and the cross-sectional area S of 3 $mm^2$ (as representative dimensions causing no severe temperature increase at the front end of the ground electrode). FIG. 12 shows the result of this analysis.

FIG. 12 is a graph showing a relationship between the height H and the bent portion temperature of the ground electrode. As shown in FIG. 12, it is understood that the bent portion temperature of the ground electrode decreases when the height H becomes smaller. When the height H is equal to or greater than 4 mm, the bent portion temperature exceeds 900° C.

From the results shown in these FIGS. 11 and 12, this embodiment sets the height H of the bent portion 42 from one end portion 10*a* of the metal housing 10 to be not less than 4 mm and not greater than 6.5 mm.

Regulating the height H within the above-described range makes it possible to adequately suppress the temperature increase in the ground electrode 40 and also makes it possible to increase the average value D of crystal grain diameters in the thickness direction to 100 μm or more during the engine operations.

Namely, according to the spark plug of the second embodiment which regulates the height H as described above, even if initial crystal grain diameters are small, recrystallization occurs at the bent portion 42 when the spark plug is used in high-temperature engine operating conditions, and accordingly the crystal grain diameters become sufficiently larger to secure excellent breakage-resisting properties. Thus, the spark plug of the second embodiment can secure sufficient breakage-resisting properties.

As described above, the second embodiment can provide a spark plug capable of securing satisfactory heat-resisting properties and breakage-resisting properties for the ground electrode 40 even when the ground electrode 40 is thinned to secure high ignitability against high mixture flow velocities.

According to the second embodiment, initial crystal grain diameters of the ground electrode 40 are not larger than 50 μm. As temperatures at the region ranging from the bent portion 42 of the ground electrode 40 to the metal housing 10 are relatively low, it is desirable to have smaller crystal grain diameters at this region from the viewpoint of strength.

Third Embodiment

A spark plug in accordance with a third embodiment of the present invention will be explained with reference to the drawings used for explaining the first embodiment. Hereinafter, differences between the first and third embodiments will be explained in detail.

The spark plug of the third embodiment includes the metal housing 10 having the fixing screw portion 11 provided on the outer surface thereof so as to be installed to an engine via the fixing screw portion 11. The insulator 20, fixed in the metal housing 10, has one end portion 20*a* protruding from one end portion 10*a* of the metal housing 10. The center electrode 30, fixed in an axial hole 21 of the insulator 20, has one end portion 30*a* protruding from one end portion 20*a* of the insulator 20. The ground electrode 40 has one end portion 41 fixed to the metal housing 10, the bent portion 42 provided at the intermediate portion thereof, and the other end portion 43 positioned in a confronting relationship with one end portion 30*a* of the center electrode 30 to form a spark discharge gap 50.

The spark plug of the third embodiment is characterized in that the ground electrode 40 contains either Ni or Fe as a main component and at least one additive selected from the group consisting of Cr and Al. The cross-sectional area S of the ground electrode 40 is not less than 2 $mm^2$ and not greater than 3 $mm^2$. And, the average value D of crystal grain diameters in the thickness direction is not greater than 50 μm Furthermore, the spark plug of the third embodiment is characterized the average value D of crystal grain diameters in the thickness direction becomes equal to or greater than 100 μm at least at the bent portion 42 of the ground electrode 40, when this spark plug is used for 10 hours or more in an engine of 2000 cc under a condition that the rotational speed is 5600 rpm and the throttle is fully opened.

As the ground electrode 40 contains either Ni or Fe as a main component and at least one additive selected from the group consisting of Cr and Al, and the cross-sectional area S of the ground electrode 40 is not less than 2 $mm^2$ and not greater than 3 $mm^2$, the spark plug of the third embodiment brings the functions and effects substantially identical with those of the spark plug S1 of the first embodiment.

Furthermore, according to the spark plug of third embodiment, although the average value D of crystal grain diameters in the thickness direction is not greater than 50 μm, the ground electrode 40 satisfies the condition that the average value D of crystal grain diameters in the thickness direction becomes equal to or greater than 100 μm at least at the bent portion 42 of the ground electrode 40, when the spark plug is used for 10 hours or more in an engine of 2000 cc under a condition that the rotational speed is 5600 rpm and the throttle is fully opened.

This arrangement can be realized, for example, by employing the above-described arrangement of the second embodiment which regulates the height H. Furthermore, the above-described used conditions of this embodiment can be realized after shipping the spark plug since this spark plug is anyhow used in a practical engine. Alternatively, it will be possible to realize the above-described used conditions before shipping the spark plug if a sufficient facility is prepared for realizing such conditions in the manufacturer of this spark plug.

In short, according to the third embodiment, the crystal grain diameters of the bent portion 42 become sufficiently larger due to recrystallization when the practical engine operating conditions become severe thermal load conditions causing breakages in the ground electrode. Accordingly, the spark plug of the third embodiment can secure excellent breakage-resisting properties.

As described above, the third embodiment can provide a spark plug capable of securing satisfactory heat-resisting properties and breakage-resisting properties for the ground electrode 40 even when the ground electrode 40 is thinned to secure high ignitability against high mixture flow velocities.

Other Embodiments

According to the present invention, it is preferable that the ground electrode 40 of the spark plug has a core material of Cu to improve its heat-dissipating properties.

Although the above-described embodiments are related to the spark plug having the ground electrode 40 being thinned to secure high ignitability against high mixture flow velocities, the fixing screw portion 11 of the spark plug has a thinned size equivalent to M10 or less so that the thinned ground electrode can be preferably used.

However, it is needless to say that the spark plug of the present invention can have the fixing screw portion 11 being larger than M10.

What is claimed is:

1. A spark plug comprising:

a metal housing having a fixing screw portion provided on an outer surface thereof so as to be installed to an engine via said fixing screw portion;

an insulator fixed in said metal housing, with one end portion protruding from one end portion of said metal housing;

a center electrode fixed in an axial hole of said insulator, with one end portion protruding from said one end portion of said insulator; and a ground electrode having one end portion fixed to said metal housing, a bent portion provided at an intermediate portion thereof, and the other end portion positioned in a confronting relationship with said one end portion of said center electrode to form a spark discharge gap, wherein said ground electrode contains either Ni or Fe as a main component and at least one additive selected from the group consisting of Cr and Al, a cross-sectional area of said ground electrode is not less than 2 $mm^2$ and not greater than 3 $mm^2$, and an average value of crystal grain diameters in a thickness direction is not less than 100 μm at least at said bent portion.

2. The spark plug in accordance with claim 1, wherein said ground electrode contains Al by an amount not less than 0.5 weight % and not greater than 2 weight %, and also contains Cr by an amount not less than 18 weight % and not greater than 25 weight %.

3. The spark plug in accordance with claim 1, wherein said ground electrode contains Al by an amount not less than 2 weight % and not greater than 5 weight % and also contains Cr by an amount not less than 10 weight % and not greater than 18 weight %.

4. The spark plug in accordance with claim 1, wherein said ground electrode contains a rare earth element.

5. The spark plug in accordance with claim 1, wherein a bending angle of said bent portion is equal to or less than 100°.

6. The spark plug in accordance with claim 1, wherein said fixing screw portion is M10 or less according to Japanese Industrial Standard.

7. The spark plug comprising:

a metal housing having a fixing screw portion provided on an outer surface thereof so as to be installed to an engine via said fixing screw portion;

an insulator fixed in said metal housing, with one end portion protruding from one end portion of said metal housing;

a center electrode fixed in an axial hole of said insulator, with one end portion protruding from said one end portion of said insulator; and a ground electrode having one end portion fixed to said metal housing, a bent portion provided at an intermediate portion thereof, and the other end portion positioned in a confronting relationship with said one end portion of said center electrode to form a spark discharge gap, wherein said ground electrode contains either Ni or Fe as a main component and at least one additive selected from the group consisting of Cr and Al, a cross-sectional area of said ground electrode is not less than 2 $mm^2$ and not greater than 3 $mm^2$, an average value of crystal grain diameters in a thickness direction is not greater than 50 μm, and a height of said bent portion from one end portion of said metal housing is not less than 4 mm and not greater than 6.5 mm.

8. The spark plug in accordance with claim 7, wherein said ground electrode contains Al by an amount not less than 0.5 weight % and not greater than 2 weight %, and also contains Cr by an amount not less than 18 weight % and not greater than 25 weight %.

9. The spark plug in accordance with claim 7, wherein said ground electrode contains Al by an amount not less than 2 weight % and not greater than 5 weight % and also contains Cr by an amount not less than 10 weight % and not greater than 18 weight %.

10. The spark plug in accordance with claim 7, wherein said ground electrode contains a rare earth element.

11. The spark plug in accordance with claim 7, wherein a bending angle of said bent portion is equal to or less than 100°.

12. The spark plug in accordance with claim 7, wherein said fixing screw portion is M10 or less according to Japanese Industrial Standard.

13. The spark plug comprising:

a metal housing having a fixing screw portion provided on an outer surface thereof so as to be installed to an engine via said fixing screw portion;

an insulator fixed in said metal housing, with one end portion protruding from one end portion of said metal housing;

a center electrode fixed in an axial hole of said insulator, with one end portion protruding from said one end portion of said insulator; and a ground electrode having one end portion fixed to said metal housing, a bent portion provided at an intermediate portion thereof, and the other end portion positioned in a confronting relationship with said one end portion of said center electrode to form a spark discharge gap, wherein said ground electrode contains either Ni or Fe as a main component and at least one additive selected from the group consisting of Cr and Al, a cross-sectional area of said ground electrode is not less than 2 $mm^2$ and not greater than 3 $mm^2$, an average value of crystal grain diameters in a thickness direction is not greater than 50 μm, and the average value of crystal grain diameters in a thickness direction becomes equal to or greater than 100 μm at least at said bent portion of said ground electrode when said spark plug is used for 10 hours or more in an engine of 2000 cc under a condition that a rotational speed is 5600 rpm and a throttle is fully opened.

14. The spark plug in accordance with claim 13, wherein said ground electrode contains Al by an amount not less than 0.5 weight % and not greater than 2 weight %, and also contains Cr by an amount not less than 18 weight % and not greater than 25 weight %.

15. The spark plug in accordance with claim 13, wherein said ground electrode contains Al by an amount not less than 2 weight % and not greater than 5 weight % and also contains Cr by an amount not less than 10 weight % and not greater than 18 weight %.

16. The spark plug in accordance with claim 13, wherein said ground electrode contains a rare earth element.

17. The spark plug in accordance with claim 13, wherein a bending angle of said bent portion is equal to or less than 100°.

18. The spark plug in accordance with claim 13, wherein said fixing screw portion is M10 or less according to Japanese Industrial Standard.

* * * * *